US009241208B2

(12) United States Patent
Ball

(10) Patent No.: US 9,241,208 B2
(45) Date of Patent: Jan. 19, 2016

(54) COMMUNICATION SHIELD ASSEMBLY

(71) Applicant: Thereasa Ball, Picayune, MS (US)

(72) Inventor: Thereasa Ball, Picayune, MS (US)

( * ) Notice: Subject to any disclaimer, the term of this patent is extended or adjusted under 35 U.S.C. 154(b) by 0 days.

(21) Appl. No.: 14/310,628

(22) Filed: Jun. 20, 2014

(65) Prior Publication Data

US 2015/0373447 A1 Dec. 24, 2015

(51) Int. Cl.
*H04R 9/08* (2006.01)
*H04R 1/08* (2006.01)

(52) U.S. Cl.
CPC ..... *H04R 1/086* (2013.01)

(58) Field of Classification Search
CPC ..... H04R 1/086; H04R 1/08; H04R 9/08
USPC ..... 381/359–360, 375, 376
See application file for complete search history.

(56) References Cited

U.S. PATENT DOCUMENTS

| | | | | |
|---|---|---|---|---|
| D337,116 | S | 7/1993 | Hattori | |
| 6,690,800 | B2 | 2/2004 | Resnick | |
| 6,935,458 | B2 | 8/2005 | Owens | |
| 7,783,034 | B2 | 8/2010 | Manne | |
| 8,437,491 | B2 * | 5/2013 | Ward | H04R 1/083 381/355 |
| 2008/0089546 | A1 | 4/2008 | Ward | |
| 2008/0134402 | A1 | 6/2008 | Bailey | |
| 2008/0304690 | A1 * | 12/2008 | Poindexter | H04R 1/08 381/375 |
| 2009/0173357 | A1 * | 7/2009 | Bonge | 132/214 |
| 2010/0034412 | A1 * | 2/2010 | Parda | H04R 1/086 381/355 |
| 2010/0185432 | A1 * | 7/2010 | Almagro | H04R 5/033 704/2 |

FOREIGN PATENT DOCUMENTS

| | | | |
|---|---|---|---|
| EP | 1150538 | A1 | 10/2001 |
| KR | 200252560 | | 7/2002 |
| KR | 1020090048931 | A | 5/2009 |
| WO | WO03065950 | | 8/2003 |
| WO | WO2009029667 | | 4/2009 |

OTHER PUBLICATIONS

Title of Source: www.coachguard.net Product Name: BroomGuard.

* cited by examiner

*Primary Examiner* — Brian Ensey
*Assistant Examiner* — Julie X Dang

(57) ABSTRACT

A communication shield assembly covers a mouth of a wearer when the wearer speaks into a mouthpiece. The assembly includes an audio headset including a head strap and a speaker. The speaker is coupled to the head strap. A microphone has an arm member and a mouthpiece. A first end of the arm member is coupled to the audio headset and a second end of the arm member is coupled to the mouthpiece. The mouthpiece extends in front of a mouth of a user for transmitting audio information to an external receiver when the user speaks into the mouthpiece. A shield is coupled to the microphone and is positioned adjacent to the mouthpiece wherein the shield covers the mouth of the user when the user speaks into the mouthpiece.

15 Claims, 5 Drawing Sheets

COMMUNICATION SHIELD ASSEMBLY

BACKGROUND OF THE DISCLOSURE

Field of the Disclosure

The disclosure relates to shield devices and more particularly pertains to a new shield device for covering a mouth of a wearer when the wearer speaks into the mouthpiece.

SUMMARY OF THE DISCLOSURE

An embodiment of the disclosure meets the needs presented above by generally comprising an audio headset including a head strap and a speaker. The speaker is coupled to the head strap. A microphone has an arm member and a mouthpiece. A first end of the arm member is coupled to the audio headset and a second end of the arm member is coupled to the mouthpiece. The mouthpiece extends in front of a mouth of a user for transmitting audio information to an external receiver when the user speaks into the mouthpiece. A shield is coupled to the microphone and is positioned adjacent to the mouthpiece wherein the shield covers the mouth of the user when the user speaks into the mouthpiece.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
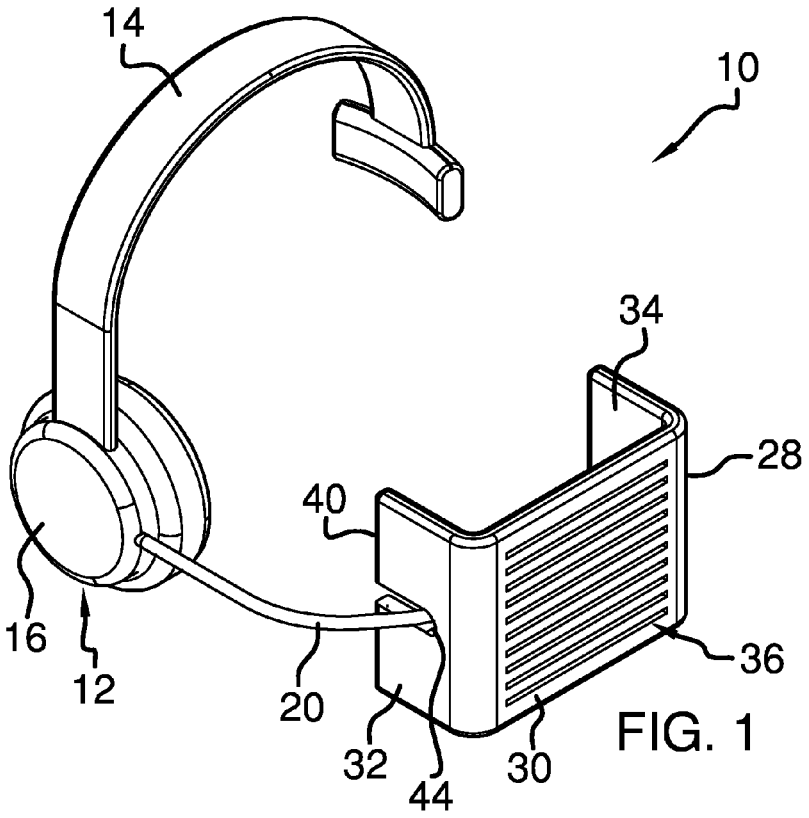
FIG. 1 is a top front side perspective view of a communication shield assembly according to an embodiment of the disclosure.
Figure 2:
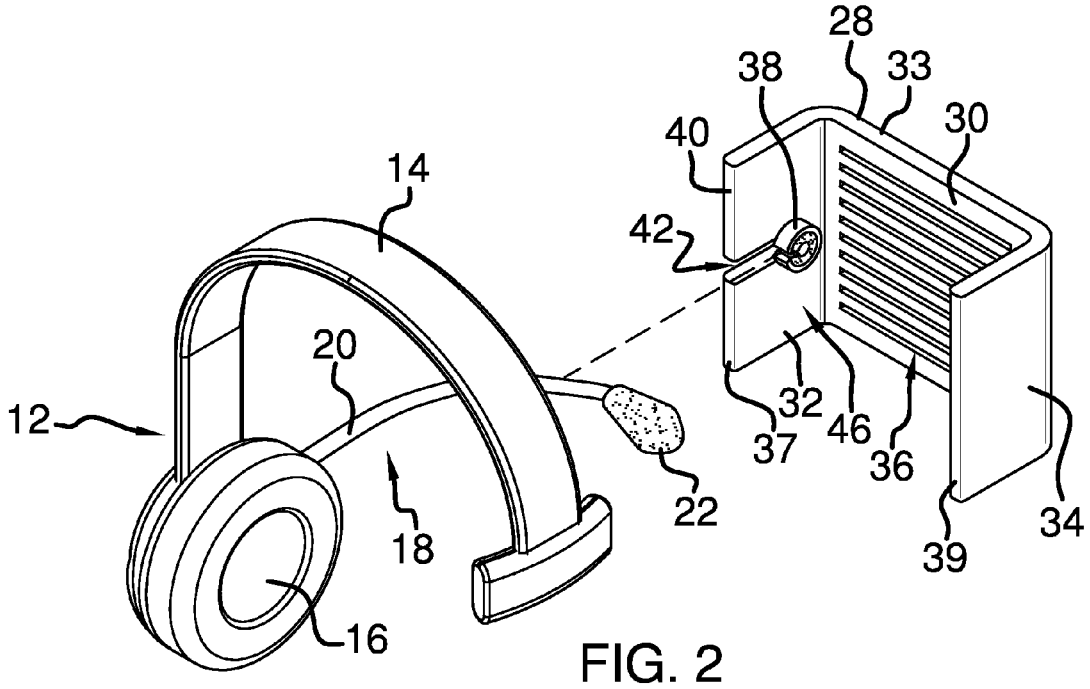
FIG. 2 is an exploded perspective view of an embodiment of the disclosure.
Figure 3:
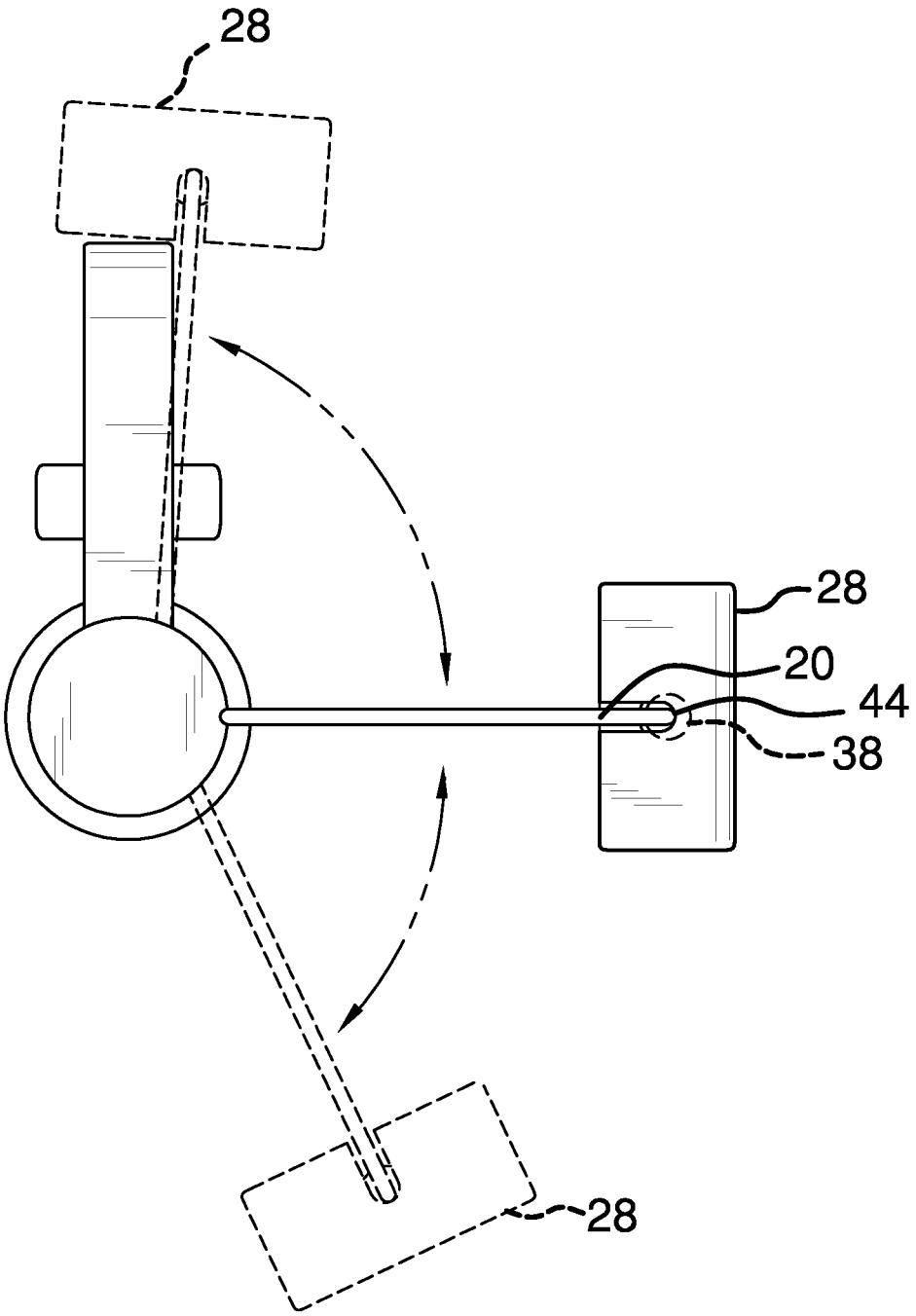
FIG. 3 is a side view of an embodiment of the disclosure.

With reference now to the drawings, and in particular to FIGS. 1 through 7 thereof, a new shield device embodying the principles and concepts of an embodiment of the disclosure and generally designated by the reference numeral 10 will be described.

As best illustrated in FIGS. 1 through 7, the communication shield assembly 10 generally comprises an audio headset 12, which may be of any conventional design. The audio headset 12 includes a head strap 14 and at least one speaker 16 coupled to the head strap 14. The head strap 14 is arcuate and constructed from a rigid material that may be water-proof or water-resistant, such as plastic or the like.

Figure 4:
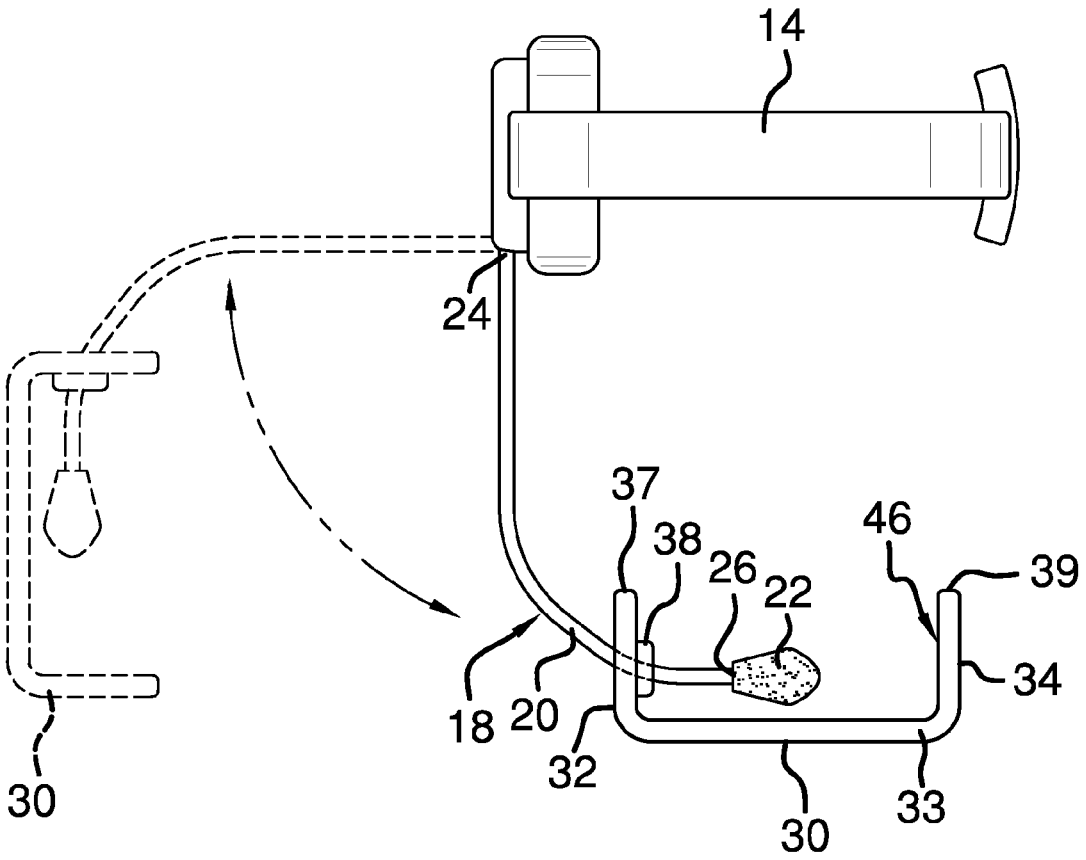
FIG. 4 is a top view of an embodiment of the disclosure.
Figure 5:
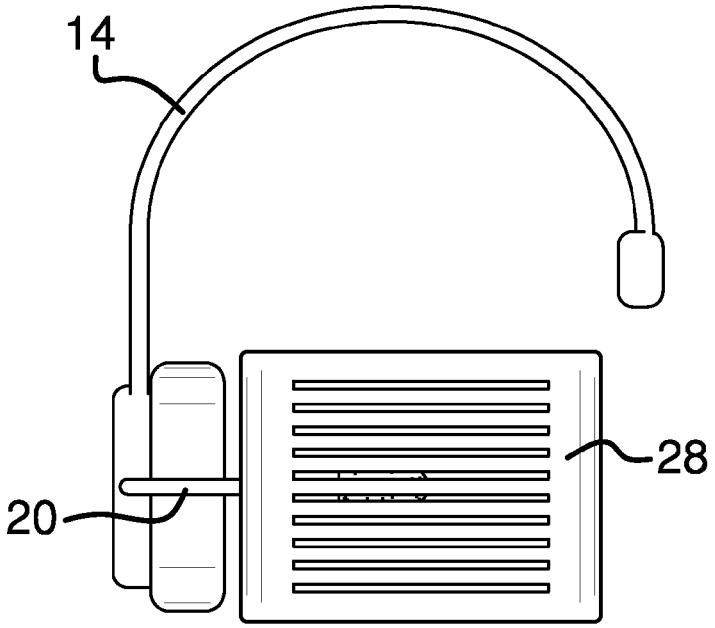
FIG. 5 is a front view of an embodiment of the disclosure.
Figure 6:
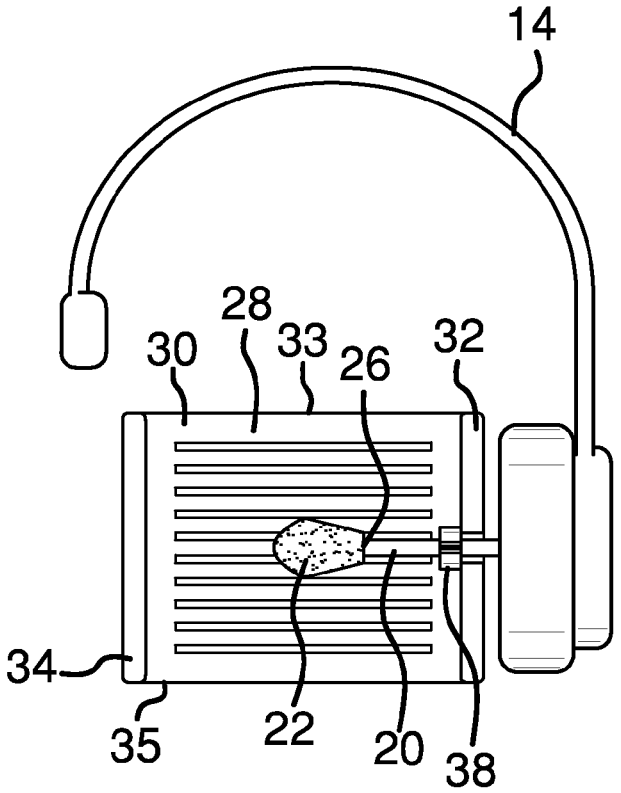
FIG. 6 is a rear view of an embodiment of the disclosure.

A microphone 18 is provided having an arm member 20 and a mouthpiece 22. A first end 24 of the arm member 20 is coupled to the audio headset 12 and a second end 26 of the arm member 20 is coupled to the mouthpiece 22. The mouthpiece 22 extends in front of a mouth of a user for transmitting audio information to an external receiver when the user speaks into the mouthpiece 22. The arm member 20 may be pivotally coupled to headset 12, and more particularly, may be pivotable upwardly relative to the head strap 12 such that the mouthpiece 22 is positionable above the head strap 14 and pivotable downwardly away from the head strap 14 such that the mouthpiece 22 is positionable under a chin of the user. As shown in FIG. 4, the arm member 20 may also be pivotable outwardly away from the head strap 12 such that the am member 20 can move laterally relative to the speaker 16.

Figure 7:
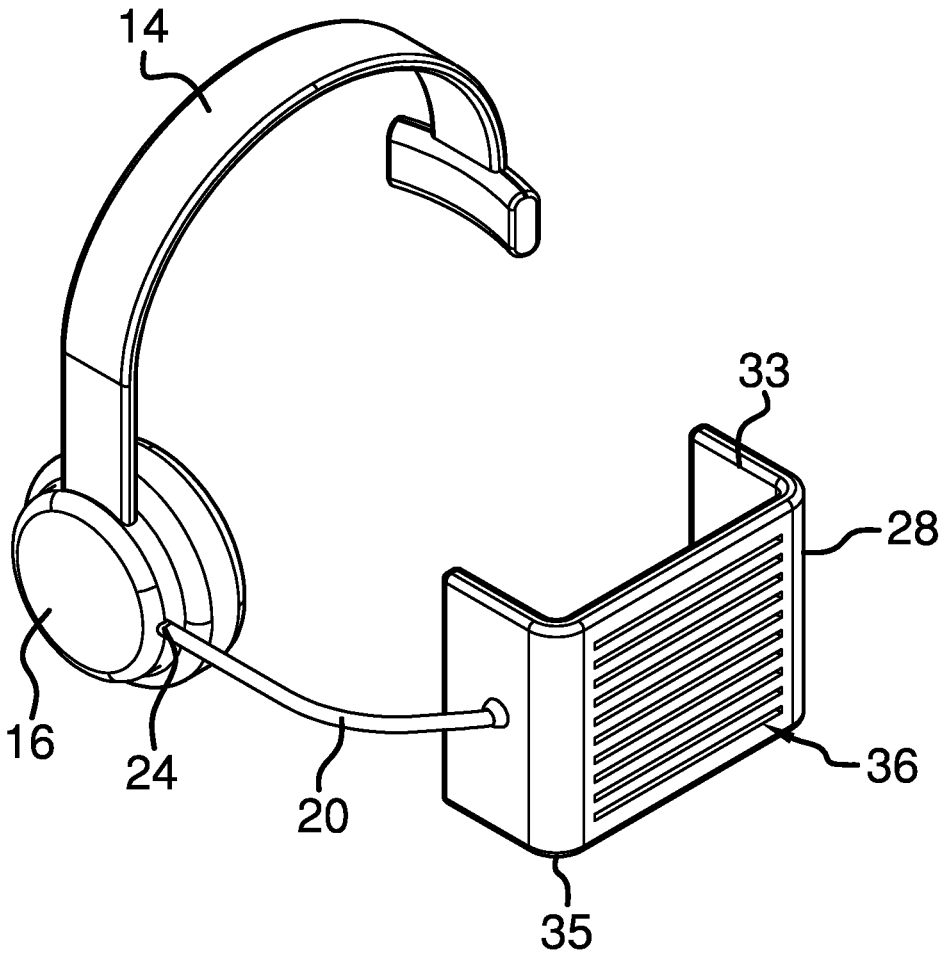
FIG. 7 is a top front side perspective view of an alternative embodiment of the disclosure.

A shield 28 is coupled to the microphone 18 and is positioned adjacent to the mouthpiece 22 wherein the shield 28 covers the mouth of the user when the user speaks into the mouthpiece 22. The shield 28 may include a main wall 30 and a pair of side walls 32, 34. Each of the side walls 32, 34 is coupled to and extends from the main wall 30 toward the audio headset 12 such that the shield 28 extends around the mouthpiece 22. The side wall 32, 34 may extend transversely from the main wall 30. Each of the side walls 32, 34 has a respective distal edge 37, 39 with respect to the main wall 30. The shield 28 may have a width measuring between approximately 8.0 cm and 13.0 cm extending between the distal edges 37, 39. The shield 28 may have a height from a top edge 33 to a bottom edge 35 of the shield 28 measuring between approximately 6.0 cm and 9.0 cm. The main wall 30 may have a plurality of vents 36 extending therein. The mouthpiece 22 is positioned adjacent to the vents 36. The shield 28 may be fixedly coupled to the microphone 18, as shown in FIG. 7.

Alternatively, the shield 28 may be removably coupled to the microphone 18, as shown in FIGS. 1-6. A clip 38 is coupled to the shield 28 for removably coupling the shield 28 to the microphone 18. A perimeter edge 40 of shield 28, and particularly the side walls 32, 34, has a slot 42 extending therein. The slot 42 receives the arm member 20. The clip 38 extends at least partially around the slot 42, and in particular, may extend around a distal end 44 of the slot 42 spaced from the perimeter edge 40 of the shield 28. The clip 38 may be coupled to an inner surface 46 of the shield 28 facing the mouthpiece 22 when the shield 28 is coupled to the microphone 18.

In use, the audio headset 12 and microphone 18 are worn in a conventional manner for receiving and transmitting audio information. However, the shield 28 can be positioned to cover the mouth of a wearer to help maintain the secrecy of audio information spoken into the mouthpiece 22. In particular, the side walls 32, 34 help to fully shield the wearer's mouth when the wearer speaks into the mouthpiece 22. This is especially useful for use by coaches during a sporting event to ensure that other coaches and members of the opposing team cannot figure out what the coach is instructing the players to do next. The microphone 18 can be pivoted upwardly, downwardly, or outwardly relative to the head strap 14 as desired.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A communication shield assembly comprising:

an audio headset including a head strap and a speaker, said speaker being coupled to said head strap;

a microphone having an arm member and a mouthpiece, a first end of said arm member coupled to said audio headset and a second end of said arm member being coupled to said mouthpiece, said mouthpiece extending in front of a mouth of a user for transmitting audio information to an external receiver when the user speaks into said mouthpiece; and a shield coupled to said microphone and positioned adjacent to said mouthpiece wherein said shield covers the mouth of the user when the user speaks into said mouthpiece, wherein said shield includes a main wall and a pair of side walls, each of said side walls being coupled to and extending from said main wall toward said audio headset, said shield extending around said mouthpiece, a perimeter edge of one of said side walls having a slot extending therein, said slot receiving said arm member therein.

2. The assembly of claim 1, further comprising wherein said shield has a plurality of vents extending therein, said mouthpiece being positioned adjacent to said vents.

3. The assembly of claim 1, further comprising wherein said arm member is pivotally coupled to headset.

4. The assembly of claim 3, further comprising wherein said arm member is pivotable upwardly relative to said head strap such that said mouthpiece is positionable above said head strap, said arm member being pivotable downwardly away from said head strap such that said mouthpiece is positionable under a chin of the user.

5. The assembly of claim 1, further comprising wherein said shield is fixedly coupled to said microphone.

6. The assembly of claim 1, further comprising wherein said shield is removably coupled to said microphone.

7. The assembly of claim 6, further comprising a perimeter edge of said shield having a slot extending therein, said slot receiving said arm member therein.

8. The assembly of claim 1, further comprising wherein said shield is removably coupled to said microphone.

9. The assembly of claim 6, further comprising a clip coupled to said shield, said clip removably coupling said shield to said microphone.

10. The assembly of claim 7, further comprising a clip coupled to said shield, said clip extending at least partially around said slot, said clip removably coupling said shield to said microphone.

11. The assembly of claim 10, further comprising said clip being coupled to an inner surface of said shield facing said mouthpiece when said shield is coupled to said microphone.

12. The assembly of claim 10, further comprising said clip extending around a distal end of said slot spaced from said perimeter edge of said shield.

13. The assembly of claim 1, further comprising wherein said main wall has a plurality of vents extending therein, said mouthpiece being positioned adjacent to said vents.

14. The assembly of claim 3, further comprising wherein said arm member is pivotable outwardly from said head strap such that said arm member is laterally movable relative to said speaker.

15. A communication shield assembly comprising:

an audio headset including a head strap and a speaker, said speaker being coupled to said head strap, said head strap being arcuate and rigid;

a microphone having an arm member and a mouthpiece, a first end of said arm member coupled to said audio headset and a second end of said arm member being coupled to said mouthpiece, said mouthpiece extending in front of a mouth of a user for transmitting audio information to an external receiver when the user speaks into said mouthpiece, said arm member being pivotally coupled to headset, said arm member being pivotable upwardly relative to said head strap such that said mouthpiece is positionable above said head strap, said arm member being pivotable downwardly away from said head strap such that said mouthpiece is positionable under a chin of the user, said arm member being pivotable outwardly from said head strap such that said arm member is laterally movable relative to said speaker;

a shield coupled to said microphone and positioned adjacent to said mouthpiece wherein said shield covers the mouth of the user when the user speaks into said mouthpiece, said shield including a main wall and a pair of side walls, each of said side walls being coupled to and extending from said main wall toward said audio headset, said shield extending around said mouthpiece, said main wall having a plurality of vents extending therein, said mouthpiece being positioned adjacent to said vents, said shield being removably coupled to said microphone, a perimeter edge of one of said side walls having a slot extending therein, said slot receiving said arm member; and a clip coupled to said shield, said clip removably coupling said shield to said microphone, said clip extending at least partially around said slot, said clip extending around a distal end of said slot spaced from said perimeter edge of said shield, said clip being coupled to an inner surface of said shield facing said mouthpiece when said shield is coupled to said microphone.

* * * * *